US006049933A

United States Patent [19]

McLaughlin

[11] Patent Number: 6,049,933

[45] Date of Patent: *Apr. 18, 2000

[54] BUMPER ASSEMBLIES FOR SWIMMING POOL CLEANERS

[75] Inventor: Shawn M. McLaughlin, Delray Beach, Fla.

[73] Assignee: Zodiac Pool Care, Inc., Ft. Lauderdale, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/909,959

[22] Filed: Aug. 12, 1997

[51] Int. Cl.[7] ..... E04H 4/16

[52] U.S. Cl. ..... 15/1.7; 15/246; 210/169; 114/219

[58] Field of Search ..... 15/1.7, 246, 325; 210/169; 114/219, 222

[56] References Cited

U.S. PATENT DOCUMENTS

| | | | |
|---|---|---|---|
| 2,330,684 | 9/1943 | Colling | 15/325 |
| 3,197,189 | 7/1965 | Pemper | 114/219 |
| 3,574,406 | 4/1971 | Wessells | 114/219 |
| 3,897,967 | 8/1975 | Barenyi | 114/219 |
| 4,152,802 | 5/1979 | Chauvier . | |
| 4,156,948 | 6/1979 | Chauvier . | |
| 4,324,301 | 4/1982 | Eyerly . | |
| 4,463,468 | 8/1984 | Chauvier . | |
| 4,548,150 | 10/1985 | Drewett | 114/219 |
| 4,642,833 | 2/1987 | Stoltz et al. . | |
| 4,742,593 | 5/1988 | Kallenbach . | |
| 4,761,848 | 8/1988 | Hofmann . | |
| 5,014,382 | 5/1991 | Kallenbach . | |
| 5,100,155 | 3/1992 | Egidio . | |
| 5,398,362 | 3/1995 | Chauvier . | |
| 5,762,016 | 6/1998 | Parsons | 114/219 |

FOREIGN PATENT DOCUMENTS

| | | |
|---|---|---|
| 0721033 | 7/1996 | European Pat. Off. . |
| 0745744 | 12/1996 | European Pat. Off. . |
| 2005993 | 5/1979 | United Kingdom . |

OTHER PUBLICATIONS

International Search Report dated Oct. 8, 1998 (3 pages).

*Primary Examiner*—Randall E. Chin
*Attorney, Agent, or Firm*—Dean W. Russell; Kilpatrick Stockton LLP

[57] ABSTRACT

Bumpers and assemblies for swimming pool cleaners are disclosed. Such assemblies may include contoured frames to which flexible fins are attached to facilitate deflection of cleaners when obstacles are encountered. Side wings connecting the frame to the body of a cleaner may additionally be employed as part of the assemblies, as may a weight moveable about two axes. In use, the side wings both promote cleaner deflection and reduce body wear that otherwise would occur. The non-stationary weight permits continuous rebalancing of the cleaner depending on its location and orientation within a pool.

20 Claims, 6 Drawing Sheets

BUMPER ASSEMBLIES FOR SWIMMING POOL CLEANERS

This invention relates to (automatic) swimming pool cleaners and in particular to bumpers for and other components of such cleaners.

BACKGROUND OF THE INVENTION

A variety of devices exist that move automatically over surfaces of swimming pools to be cleaned. One such pool cleaner operates in cooperation with the reduced pressure caused by a pump to induce debris-laden fluid within a pool to flow through the cleaner (and other filtration equipment if desired). The cleaner functions by causing a valve, or diaphragm, to oscillate, periodically interrupting the fluid flow through the cleaner. This periodic interruption in turn causes movement of the device over the surface to be cleaned. Exemplary cleaners of this type are disclosed in U.S. Pat. Nos. 4,642,833 and 4,742,593, which patents are incorporated herein in their entireties by this reference.

U.S. Pat. No. 5,014,382 ("the Kallenbach patent"), also incorporated herein in its entirety by reference, discloses another fluid-interruption version of an automatic swimming pool cleaner. Illustrated in the Kallenbach patent as being attached to the cleaner are a bumper and a retainer that includes a weight. The retainer, which is integrally formed with a portion of the body of the cleaner, thereby fixes the position of the weight relative to the body. Moreover, rigid plastic is used to form the bumpers of commercially-available cleaners made according to the Kallenbach patent. As noted in the Kallenbach patent (col. 3, line 65 through col. 4, line 3), the bumper, when it contacts an obstruction, assists in lifting the flexible disc of a cleaner > from the surface and thus breaking the pressure holding the disc . . . to the surface being traversed. This allows the cleaner . . . to move freely until it disengages from the obstruction.

SUMMARY OF THE INVENTION

The present invention, by contrast, provides alternative bumper assemblies for swimming pool cleaners. Unlike the bumper of the Kallenbach patent, for example, that of the present invention may include a flexible edge, or fin, attached to the main frame of the bumper. The fin and contour of the main frame facilitate deflection of the associated cleaner when obstacles are encountered. They also aid in the cleaner transitioning from traversing the bottom of the pool to cleaning its sides. The ability of the cleaner to climb steps sometimes found in pools additionally is enhanced by the shape of the frame.

Further features of the present invention include side wings connecting the frame to the body of the cleaner. These wings too may have flexible leading edges to promote deflection of the cleaner when obstacles (particularly steps and ladders) are encountered. The side wings, as well as the frame, also reduce cleaner body wear that otherwise would occur from frictional contact with the walls of and obstacles placed within swimming pools.

Unlike the cleaners of the Kallenbach patent, moreover, those of the present invention include a mobile—rather than stationary—weight. The weight, in some embodiments positioned about a tapered section of the main frame of the bumper assembly, is adapted to slide, or move, in two axes: longitudinally along the length of the section and laterally across its (tapered) width. Such movement occurs automatically as the cleaner operates, effectively continuously rebalancing it depending on its location and orientation within the pool. The action of the weight can also result in increased pool coverage per unit time by the cleaner.

It is therefore an object of the present invention to provide a bumper or bumper assembly for an automatic swimming pool cleaner.

It is also an object of the present invention to provide a bumper assembly adapted to facilitate deflection of the cleaner when obstacles are encountered in use.

It is another object of the present invention to provide a bumper assembly in which such deflection is facilitated by a flexible fin, which in at least some embodiments is attached to a rigid, contoured frame.

It is a further object of the present invention to provide side wings, or similar wear-preventing structures, connecting the frame to the body of the cleaner.

It is yet another object of the present invention to provide a system, repositionable in use, for balancing the cleaner with which it is associated.

It is also an object of the present invention to provide such a system that includes a weight adapted to move along two axes.

It is an additional object of the present invention to provide such a system in which the action of the weight can result in increased pool coverage per unit time by the cleaner.

Other objects, features, and advantages of the present invention will become apparent with reference to the remainder of the text and the drawings of this application.

DETAILED DESCRIPTION

Figure 1:
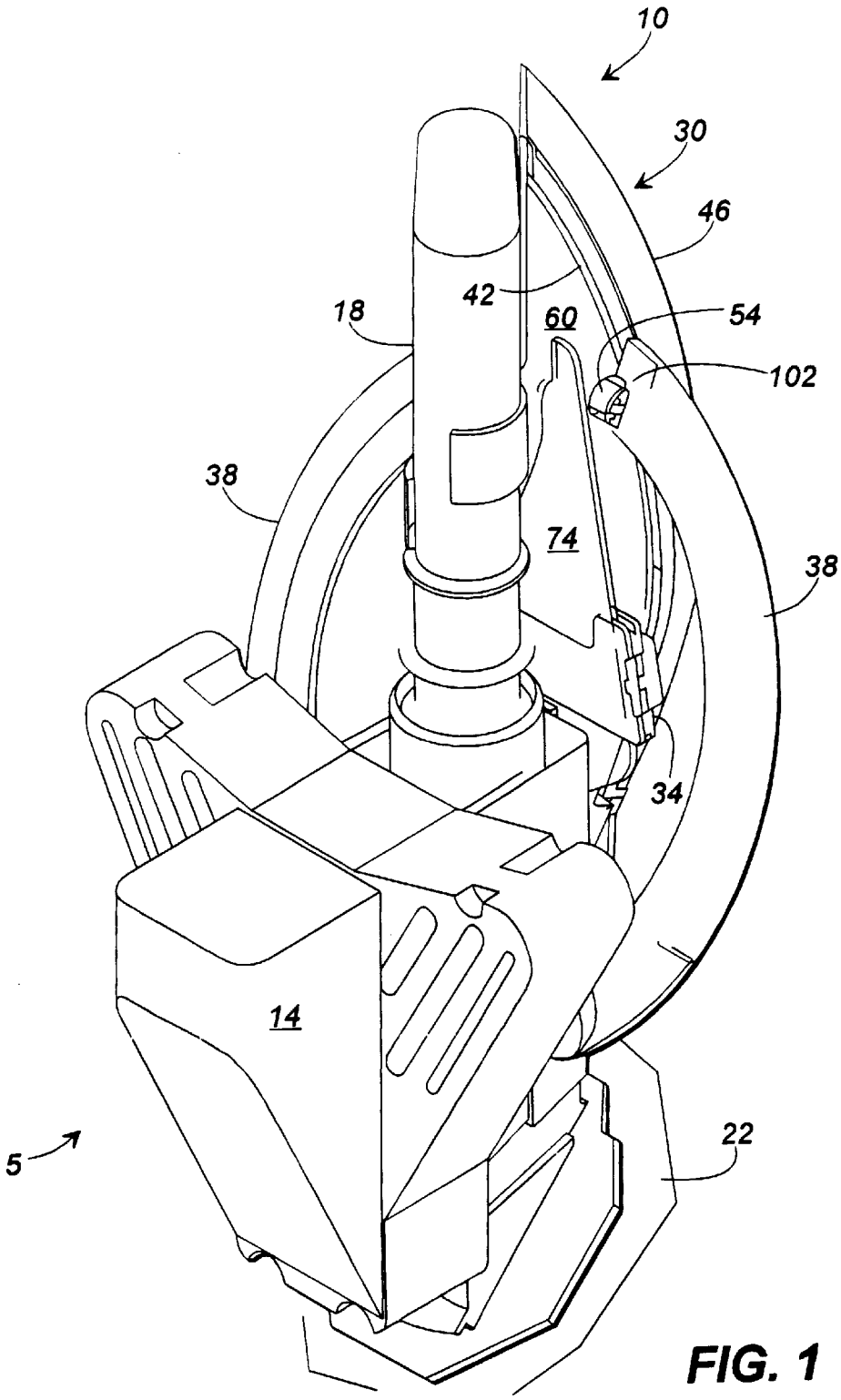
FIG. 1 is a perspective view of portions of a swimming pool cleaner containing a bumper assembly of the present invention.
Figure 2:
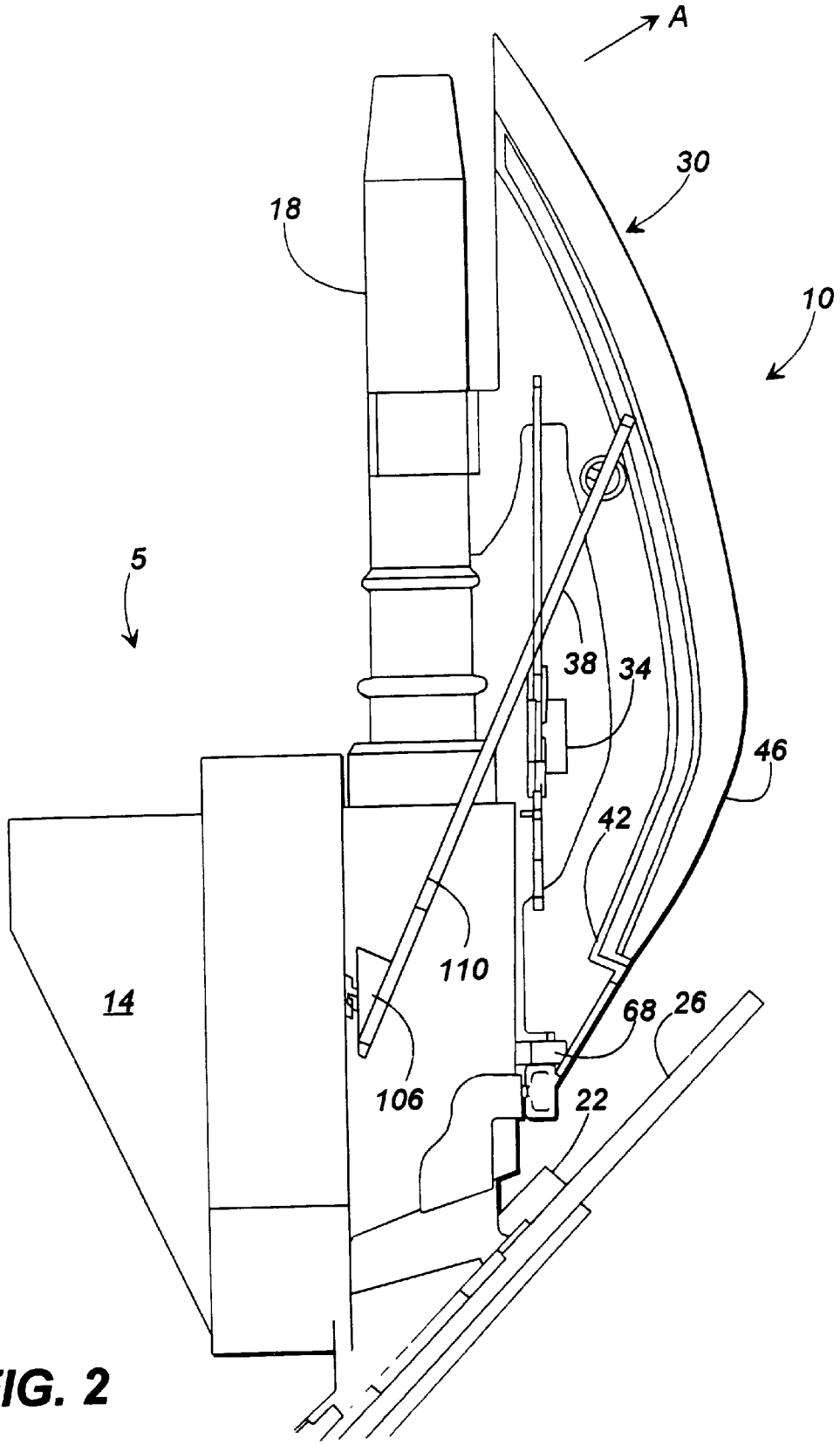
FIG. 2 is a side elevational view of the swimming pool cleaner of FIG. 1.

FIGS. 1–2 show an exemplary automatic swimming pool cleaner S to which bumper assembly 10 of the present invention is connected. As with many commercially-available pool cleaners, cleaner S includes a body 14 to which an extension pipe 18 is attached or formed. Also used as part of cleaner S are a footpad 22, shown in FIGS. 1–2, and a flexible disc 26. Cleaner S typically moves generally in the direction of arrow A when upright, thus often making bumper assembly 10 the leading edge of the cleaning device.

Figure 3:
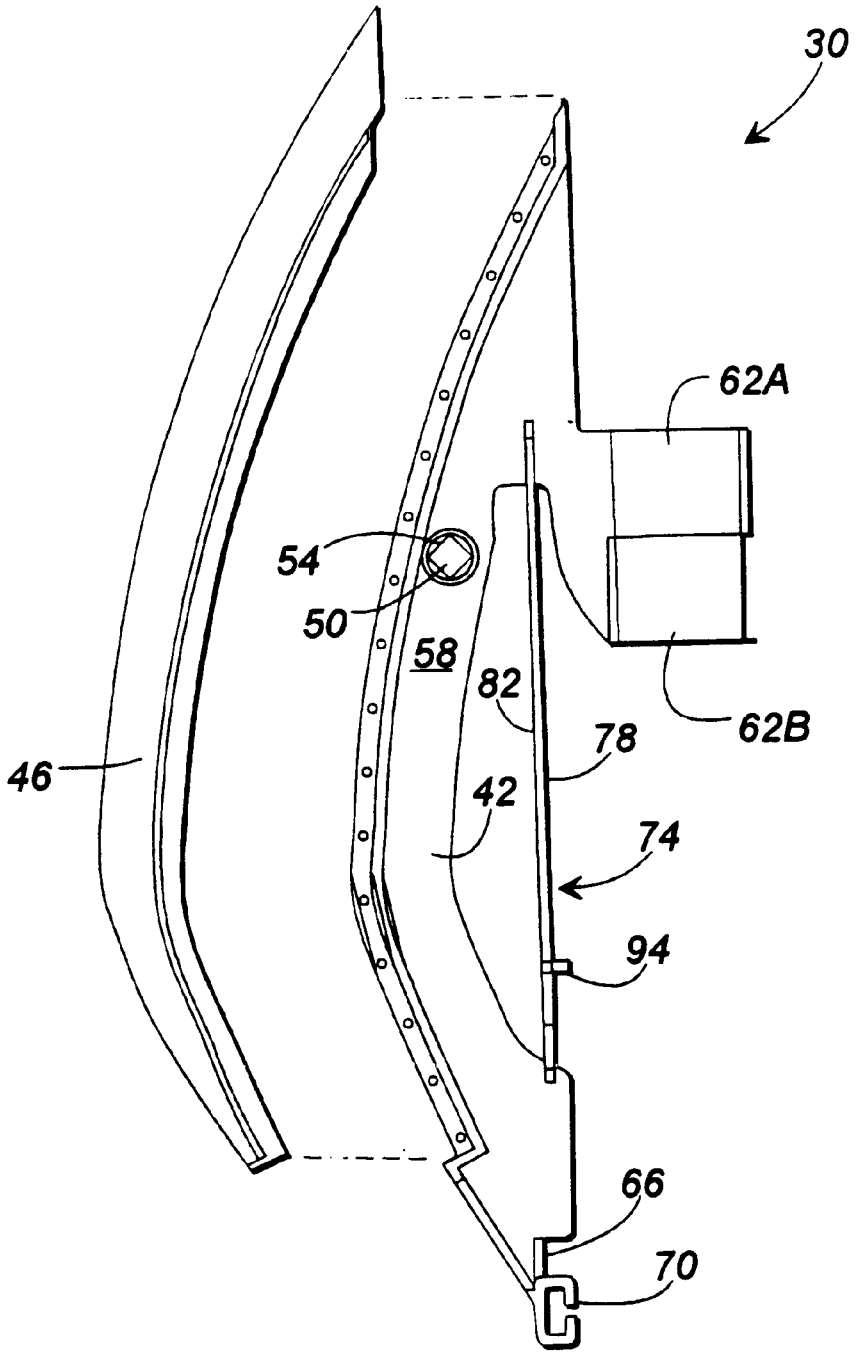
FIG. 3 is a partially-exploded side elevational view illustrating the main frame and fin of the bumper assembly of FIG. 1.

Included in embodiments of assembly 10 are bumper 30, weight assembly 34, and side wings 38. FIG. 3 illustrates bumper 30, which in the illustrated embodiment is oriented approximately forty-five degrees from the horizontal plane when body 14 is upright and comprises main frame 42 and fin 46. Frame 42 may be formed of plastic or other material that is substantially rigid, while fin 46 is normally composed of flexible material such as polyurethane (or any appropriate thermoplastic elastomer or rubber). Fin 46 is designed to attach to frame 42 in any suitable manner, including (although not exclusively) through use of a water-insoluble adhesive.

The flexibility and curvature of fin 46 facilitate deflection of cleaner S should it encounter certain obstacles in a pool. These characteristics of fin 46 additionally enhance the ability of cleaner S to climb any underground stairs in the pool, promoting cleaning of their otherwise relatively hard-to-access perpendicular surfaces. The contour of fin 46 further assists cleaner S in the transition from cleaning the bottom of a pool to cleaning one of its sides.

Frame 42 may include opening 50, in which collar 54 may be incorporated. Although not readily visible in FIG. 3, collar 54, when present, may protrude from both surface 58 of frame 42 and from its opposite (reverse) surface 60. Collar 54 is adapted to receive side wings 38, as described hereafter in greater detail; in its absence, such wings 38 may in some cases simply be received by opening 50.

Additionally contained as part of frame 42 are split collars 62A and 62B. Each semi-cylindrically shaped, split collar 62A and 62B connect frame 42 to (cylindrical) extension pipe 18 of cleaner S. The mechanical fit provided by split collars 62A and 62B retains them in place, thus fixing the position of frame 42 relative to extension pipe 18. In some embodiments of bumper assembly 10, split collars 62A and 62B are integrally formed with frame 42. This is not necessary, however, as water-insoluble adhesives or other connection media alternatively may be employed. Those skilled in the art will also recognize that other mechanisms for connecting the frame 42 to cleaner S may be used instead of split collars 62A and 62B.

To brace the connection with cleaner S, frame 42 further may contain a recess or slot 66 into which a corresponding protrusion 68 extending from body 14 is fitted. If necessary or desired, a clip 70 may also be included as part of frame 42 for connection to body 14. Neither slot 66 nor clip 70 is required for satisfactory operation of bumper assembly 14, although having either or both may improve the deflection response of bumper 30 when it contacts an obstacle within a pool.

Additionally included as part of frame 42 is tapered section 74. Preferably (although not necessarily) integrally formed as part of frame 42, tapered section 74 provides surfaces 78 and 82 along which weight assembly 34 slides. Surfaces 78 and 82 are, in embodiments of the invention consistent with FIG. 3, perpendicular to surfaces 58 and 60 of frame 42. They need not be ninety degrees removed, however, nor must they be flat as illustrated in the figure.

Figure 4A:
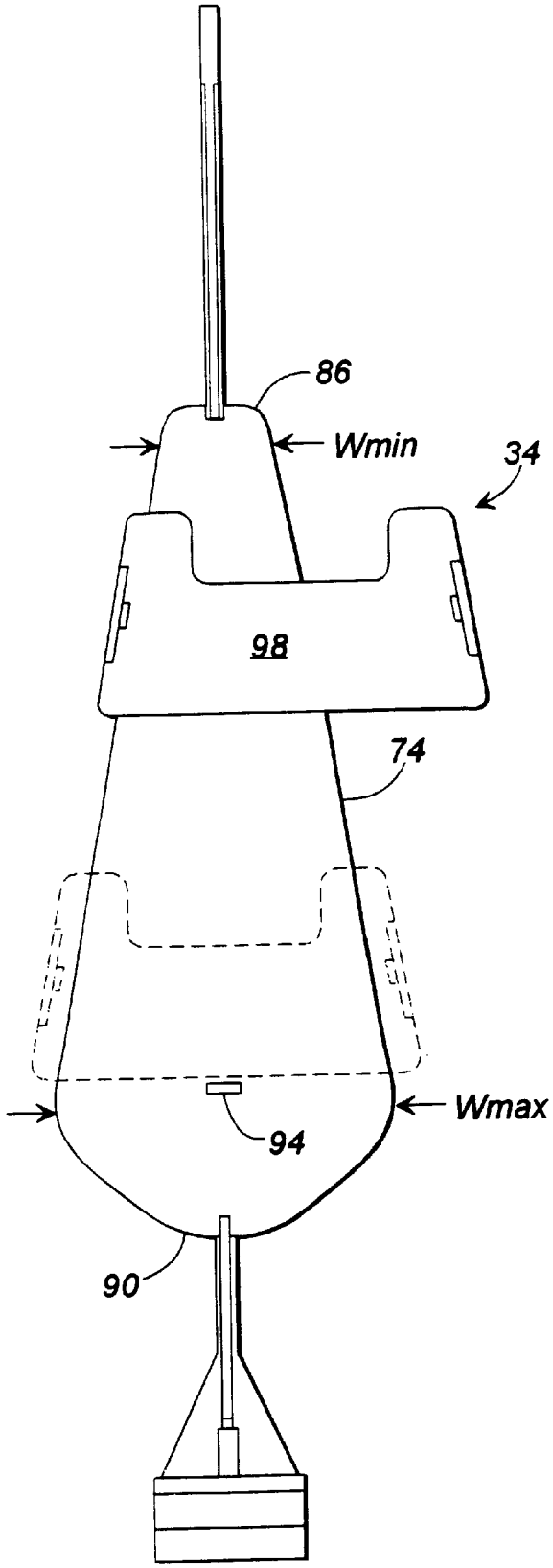
FIGS. 4A and 4B are diagrammatic views illustrating various positionings of a weight assembly useable as part of the bumper assembly of FIG. 1.
Figure 4B:
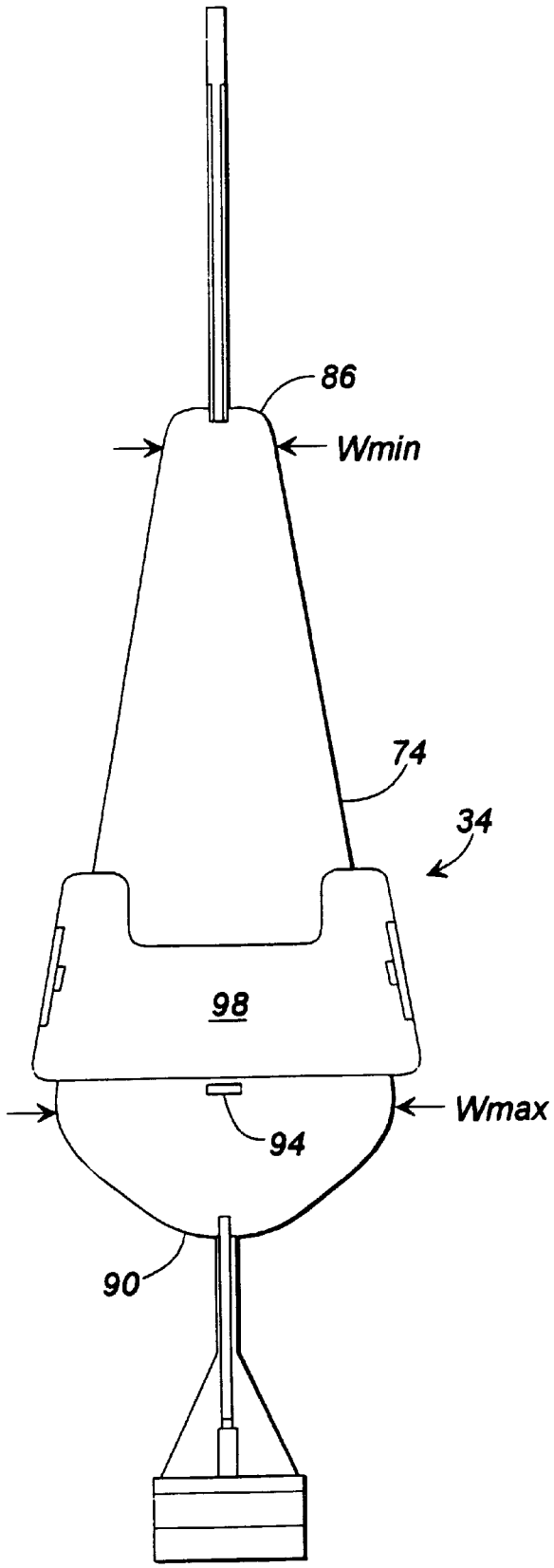

FIGS. 4A and 4B show the contour of an exemplary section 74. In particular, section 74 has minimum width $W_{min}$ at or near its top 86. By contrast, maximum width $W_{max}$ exists for section 74 at or near its bottom 90. Section 74 further includes stop 94, which protrudes from and typically is integrally formed with surface 78.

Figure 5:
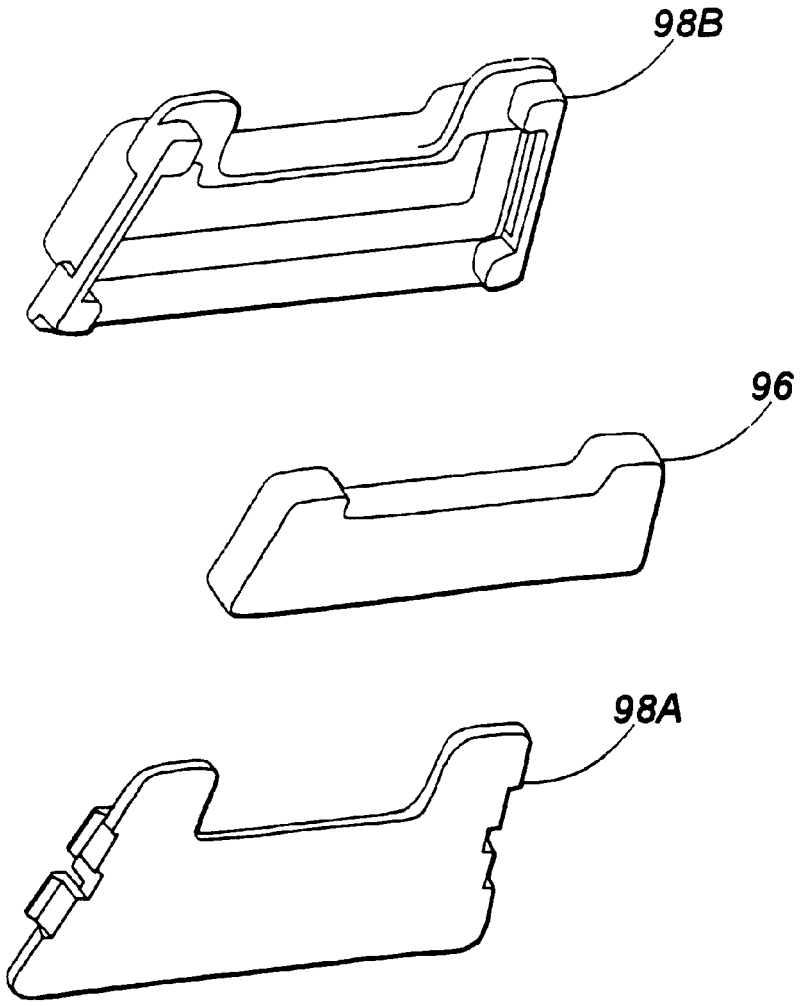
FIG. 5 is an exploded perspective view of the weight assembly of FIG. 4.

FIGS. 4A and 4B, as well as FIG. 5, detail weight assembly 34 of the present invention. In preferred embodiments of the invention, weight assembly 34 comprises both a weight 96 and a housing 98 (which may comprise connectable components 98A and 98B) in which weight 96 is placed. In these embodiments, housing 98 is designed so as not to permit weight 96 to move therein but rather to secure it in place.

During manufacture of bumper assembly 10, housing 98 of these embodiments may be fitted about section 74. If necessary for replacement or repair, housing 98 may be made to be removable from section 74. Otherwise, housing 98 is intended to remain surrounding section 74 throughout operation of pool cleaner S.

As shown in FIG. 4B, the internal width of housing 98 is approximately equal to $W_{max}$. As a consequence, when housing 98 approaches bottom 90 of section 74, it cannot move significantly laterally across the section 74. By contrast, the internal width of housing 98 is substantially larger than $W_{min}$. Accordingly, as housing 98 approaches top 86 of section 74, its lateral movement is relatively uncircumscribed (as shown in FIG. 4A). To prevent housing 98 from lodging (jamming) near bottom 90 of section 74, stop 94 may be employed.

When cleaner S traverses the bottom of a pool with body 14 upright, weight assembly 34 is typically stationary, positioned near bottom 90 abutting stop 94. As cleaner S successfully climbs to the top of the side wall of a pool, its natural tendency is to turn and move horizontally along the side wall rather than return to the pool floor. However, as cleaner S begins to become oriented horizontally, weight assembly 34 commences movement (sliding) along section 74 from bottom 90 toward top 86. Movement of weight assembly 34 changes the balance of cleaner S by increasing the moment around an axis perpendicular to the side wall of the pool, causing cleaner S to dive back down to the bottom of the pool. When cleaner S reaches the pool bottom and body 14 is again upright, weight assembly 34 returns to its nominal resting position abutting stop 94, and cleaner S continues traversing the bottom of the pool. In many cases, the action of weight assembly 34 enhances the rate of pool coverage cleaner S can provide.

Side wings 38, when present, help reduce wear of body 14 occurring because of frictional contact of the body 14 with walls of and obstacles within a swimming pool. FIG. 1 illustrates two such wings 38 oriented substantially horizontally (in contrast to bumper 30), each having an end 102 received by collar 54. Ends 102 are fitted or otherwise adapted so as to be retained within collar 54 as cleaner S operates, with wings 38 thereby shielding body 14 from certain contacts. Opposite ends 106 of wings 38 are typically connected to body 14 in any suitable manner. Like bumper 30, wings 38 may have flexible leading edges 110 to promote deflection of cleaner S when obstacles—particularly steps and ladders—are encountered. Any cleaner S with which the present invention is utilized is thus capable not only of enhanced performance in diving to the bottom of a pool, but also of having increased useful life because of decreased wear.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A bumper assembly for a swimming pool cleaner comprising (i) an extension pipe and (ii) a body, the assembly having a leading edge and comprising:

a. a substantially rigid frame;

b. means, comprising a flexible section forming the leading edge and which is connected to the substantially rigid frame, for facilitating the swimming pool cleaner deflecting off obstacles in use; and c. means for connecting the frame to the swimming pool cleaner, the means comprising (i) means for connecting the assembly to the extension pipe of the swimming pool cleaner and (ii) means for connecting the assembly to the body of the swimming pool cleaner.

2. A bumper assembly according to claim 1 further comprising a weight assembly connected to the substantially rigid frame.

3. A bumper assembly for a swimming pool cleaner, the assembly having a leading edge and comprising:

a. a substantially rigid frame;

b. means, comprising a flexible section forming the leading edge and which is connected to the substantially rigid frame, for facilitating the swimming pool cleaner deflecting off obstacles in use;

c. means for connecting the frame to the swimming pool cleaner; and d. a weight assembly connected to the substantially rigid frame and comprising:

i. a weight; and ii. means for permitting the weight to move about two axes relative to the swimming pool cleaner.

4. A bumper assembly according to claim 3 in which the movement permitting means comprises a tapered section connected to the substantially rigid frame.

5. A bumper assembly according to claim 4 in which the tapered section has a stop protruding therefrom and defines a length and maximum and minimum widths.

6. A bumper assembly according to claim 5 in which the tapered section receives the weight so as to permit the weight to move longitudinally along its length and laterally across at least its minimum width.

7. A bumper assembly according to claim 6 in which at least one of the stop and maximum width limit movement of the weight about at least one axis relative to the swimming pool cleaner.

8. A bumper assembly for a swimming pool cleaner, the assembly having a leading edge and comprising:

a. a substantially rigid frame;

b. means, comprising a flexible section forming the leading edge and which is connected to the substantially rigid frame, for facilitating the swimming pool cleaner deflecting off obstacles in use;

c. means for connecting the frame to the swimming pool cleaner; and d. a first wing connected to the substantially rigid frame.

9. A bumper assembly according to claim 8 further comprising (i) a body and (ii) a second wing connected to the substantially rigid frame, the first and second wings being oriented substantially horizontally when the body is upright.

10. A bumper assembly according to claim 9 in which the first and second wings are also connected to the body.

11. An automatic swimming pool cleaner comprising:

a. a body;

b. an extension pipe connected to the body; and c. a bumper assembly comprising:

i. a frame defining an opening;

ii. a leading edge comprising a flexible member connected to the frame;

iii. a collar extending through the opening;

iv. a plurality of split rings connecting the frame to the extension pipe;

v. means for connecting the frame to the body;

vi. at least one side wing received by the collar and connected to the body, the side wing being oriented substantially horizontally when the body is upright; and vii. a weight assembly connected to the frame.

12. An automatic swimming pool cleaner according to claim 11 in which the weight assembly comprises:

a. a weight; and b. means for permitting the weight to move about two axes relative to the body.

13. An automatic swimming pool cleaner according to claim 12 in which the movement permitting means comprises a tapered section connected to the frame.

14. An automatic swimming pool cleaner according to claim 13 in which the tapered section has a stop protruding therefrom and defines a length and maximum and minimum widths.

15. An automatic swimming pool cleaner according to claim 14 in which the tapered section receives the weight so as to permit the weight to move longitudinally along its length and laterally across at least its minimum width.

16. An automatic swimming pool cleaner according to claim 15 in which at least one of the stop and maximum width limit movement of the weight about at least one axis relative to the body.

17. A bumper assembly for a swimming pool cleaner, the assembly having a leading edge and comprising:

a. a substantially rigid frame;

b. a flexible, elongated fin constituting the leading edge and connected to the substantially rigid frame, the fin facilitating the swimming pool cleaner deflecting off obstacles in use; and c. means, comprising a connector, for connecting the frame to the swimming pool cleaner.

18. A bumper assembly for a swimming pool cleaner, the assembly having a leading edge and comprising:

a. a substantially rigid frame;

b. a flexible, elongated fin constituting the leading edge and connected to the substantially rigid frame, the fin facilitating the swimming pool cleaner deflecting off obstacles in use;

c. a connector for connecting the frame to the swimming pool cleaner; and d. a weight assembly connected to the substantially rigid frame.

19. A bumper assembly according to claim 18 in which the weight assembly comprises:

a. a weight; and b. means for permitting the weight to move about two axes relative to the swimming pool cleaner.

20. A swimming pool cleaner having a bumper assembly connected thereto, the bumper assembly having a leading edge and comprising:

a. a substantially rigid frame;

b. a flexible, elongated fin constituting the leading edge and connected to the substantially rigid frame, the fin facilitating the swimming pool cleaner deflecting off obstacles in use; and c. a connector for connecting the frame to the swimming pool cleaner.

* * * * *